US010660366B2

(12) United States Patent
Alarcon

(10) Patent No.: US 10,660,366 B2
(45) Date of Patent: May 26, 2020

(54) WICK-POSITIONING CARTOMIZER

(71) Applicant: Fontem Holdings 2 B.V., Amsterdam (NL)

(72) Inventor: Ramon Alarcon, Los Gatos, CA (US)

(73) Assignee: Fontem Holdings 4 B.V., Amsterdam (NL)

( * ) Notice: Subject to any disclaimer, the term of this patent is extended or adjusted under 35 U.S.C. 154(b) by 0 days.

(21) Appl. No.: 15/011,027

(22) Filed: Jan. 29, 2016

(65) Prior Publication Data

US 2016/0219936 A1 Aug. 4, 2016

Related U.S. Application Data

(60) Provisional application No. 62/110,089, filed on Jan. 30, 2015.

(51) Int. Cl.

| | |
|---|---|
| ***A24F 47/00*** | (2020.01) |
| ***H05B 3/00*** | (2006.01) |
| ***H05B 3/12*** | (2006.01) |

(52) U.S. Cl.

CPC ..... *A24F 47/008* (2013.01); *H05B 3/0014* (2013.01); *H05B 3/12* (2013.01)

(58) Field of Classification Search

CPC ..... A24F 47/008; H05B 3/0014; H05B 3/12

USPC ..... 392/395; 131/328, 329

See application file for complete search history.

(56) References Cited

U.S. PATENT DOCUMENTS

| | | | | |
|---|---|---|---|---|
| 8,678,012 | B2 * | 3/2014 | Li | A24F 47/008 128/202.21 |
| 2012/0234821 | A1 * | 9/2012 | Shimizu | A24F 47/008 219/227 |
| 2013/0192615 | A1 * | 8/2013 | Tucker | H01C 17/00 131/328 |
| 2013/0213419 | A1 * | 8/2013 | Tucker | A24F 47/008 131/328 |
| 2013/0340778 | A1 * | 12/2013 | Liu | A24F 47/002 131/329 |
| 2014/0190496 | A1 * | 7/2014 | Wensley | A24F 47/008 131/273 |
| 2014/0202474 | A1 * | 7/2014 | Peleg | G06T 7/0008 131/328 |
| 2014/0209105 | A1 * | 7/2014 | Sears | F22B 1/28 131/328 |
| 2014/0270730 | A1 * | 9/2014 | DePiano | A24F 47/008 392/404 |
| 2015/0027471 | A1 | 1/2015 | Feldman et al. | |
| 2015/0196056 | A1 | 7/2015 | Liu | |
| 2015/0216236 | A1 * | 8/2015 | Bless | B23K 26/20 131/328 |
| 2015/0366265 | A1 * | 12/2015 | Lansing | A24F 47/004 131/329 |
| 2016/0073693 | A1 * | 3/2016 | Reevell | H05B 1/0244 131/329 |
| 2016/0106155 | A1 * | 4/2016 | Reevell | A24F 47/008 131/329 |

(Continued)

FOREIGN PATENT DOCUMENTS

| | | | |
|---|---|---|---|
| WO | 2013083635 | A1 | 6/2013 |
| WO | 2013083638 | A1 | 6/2013 |

*Primary Examiner* — Dana Ross
*Assistant Examiner* — Joe E Mills, Jr.
(74) *Attorney, Agent, or Firm* — Dykema Gossett PLLC

(57) ABSTRACT

A cartomizer of an electronic smoking article comprises a partially slit air tube configured to position a heater coil surrounding a wick.

19 Claims, 3 Drawing Sheets

(56) References Cited

U.S. PATENT DOCUMENTS

2016/0366725 A1* 12/2016 Tucker ..... H05B 3/06

* cited by examiner

WICK-POSITIONING CARTOMIZER

CROSS-REFERENCE TO RELATED APPLICATIONS

This application claims priority to U.S. provisional patent application No. 62/110,089, filed 30 Jan. 2015, which is hereby incorporated by reference as though fully set forth herein.

BACKGROUND OF THE DISCLOSURE a. Field of the Invention

The present disclosure relates to a device for positioning a wick within an electronic smoking article, and more particularly to a partially slit air tube within the electronic smoking article.

b. Background Art

Electronic cigarettes, also known as e-cigarette (eCigs) and personal vaporizers (PVs), are electronic inhalers that vaporize or atomize a liquid solution into an aerosol mist that may then be delivered to a user. A typical eCig has two main parts—a battery part and a cartomizer. The battery part typically includes a rechargeable lithium-ion (Li-ion) battery, a light emitting diode (LED), and a pressure sensor. The cartomizer typically includes a liquid solution, an atomizer and a mouthpiece. The atomizer typically includes a heating coil that vaporizes the liquid solution.

BRIEF SUMMARY OF THE DISCLOSURE

According to one non-limiting example of the disclosure, a cartomizer of an electronic smoking article comprises a partially slit air tube configured to position a heater coil surrounding a wick.

In one embodiment a cartomizer comprises an air tube extending longitudinally within an electronic smoking article, the air tube comprising a proximal end and a distal end; and a heater coil positioned within the air tube, the heater coil configured to hold and surround a wick; wherein the air tube further comprises a slot configured to position the heater coil; and wherein the heater coil is positioned within the slot such that the heater coil and the wick surrounded by the heater coil do not come into contact with the air tube.

In another embodiment, an electronic smoking article comprises a cartomizer comprising (i) an air tube extending longitudinally within a housing, the air tube comprising a proximal end and a distal end, (ii) and a heater coil positioned within the air tube, the heater coil configured to hold and surround a wick; wherein the air tube further comprises a slot configured to position the heater coil; and wherein the heater coil is positioned within the slot such that the heater coil and the wick surrounded by the heater coil do not come into contact with the air tube; and a battery part configured to be coupled with the cartomizer.

In another embodiment, an air tube is configured for use with an electronic smoking article, the air tube extending longitudinally within a housing of the electronic smoking article; and a heater coil is positioned within the air tube, the heater coil configured to hold and surround a wick; wherein the air tube comprises a slot configured to position the heater coil; and wherein the heater coil is positioned within the slot such that the heater coil and the wick surrounded by the heater coil do not come into contact with the air tube.

Additional features, advantages, and embodiments of the disclosure may be set forth or apparent from consideration of the detailed description and drawings. Moreover, it is to be understood that the foregoing summary of the disclosure and the following detailed description and drawings are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 1:
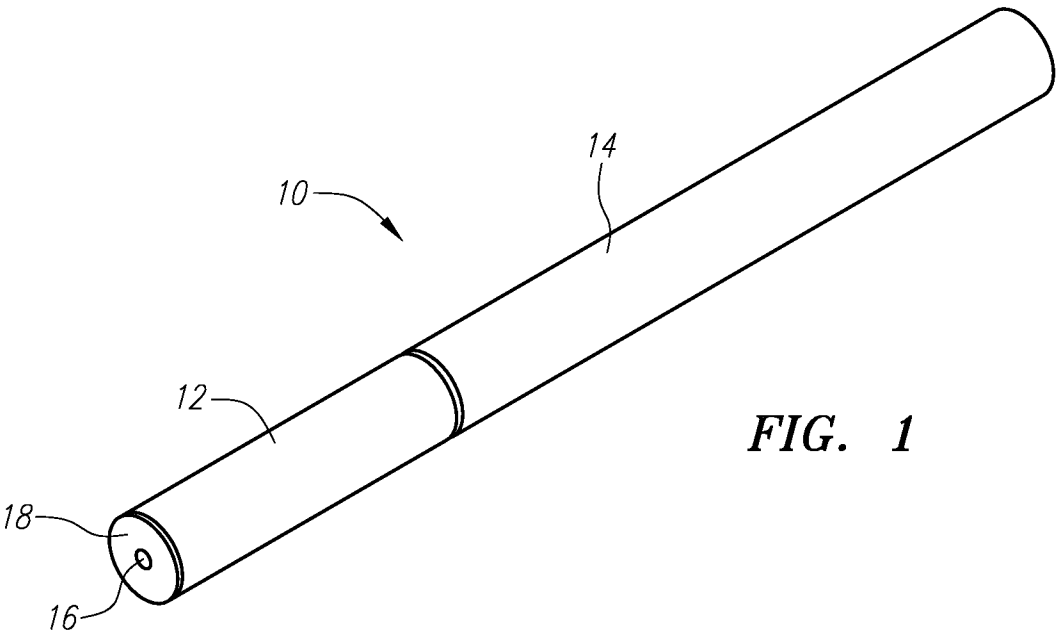
FIG. 1 is a schematic view of an example of an electronic smoking article that is constructed according to an aspect of the disclosure.

The disclosure and the various features and advantageous details thereof are explained more fully with reference to the non-limiting embodiments and examples that are described and/or illustrated in the accompanying drawings and detailed in the following. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

FIG. 1 is a schematic view of an example of an electronic article 10 according to an aspect of the disclosure. In the instant example, the electronic article 10 comprises an eCig. However, the electronic article 10 may comprise any article that may be charged by an external power supply, such as, e.g., a rechargeable battery, or the like.

The eCig 10 comprises a cartomizer 12 and an eCig body 14. The cartomizer 12 comprises an opening 16 in a mouthpiece 18 through which aerosol may be delivered to a user.

The cartomizer 12 comprises a solution (not shown) and an atomizer (not shown). The solution may include, e.g., a liquid, a gel, a solid, or a gas that comprises molecules (or particles) to be delivered in an aerosol to a user. The eCig body 14 includes a power supply (e.g., a rechargeable Li-ion battery) (shown in FIGS. 8 and 9) and a light-emitting diode (LED) indicator (not shown).

Figure 2:
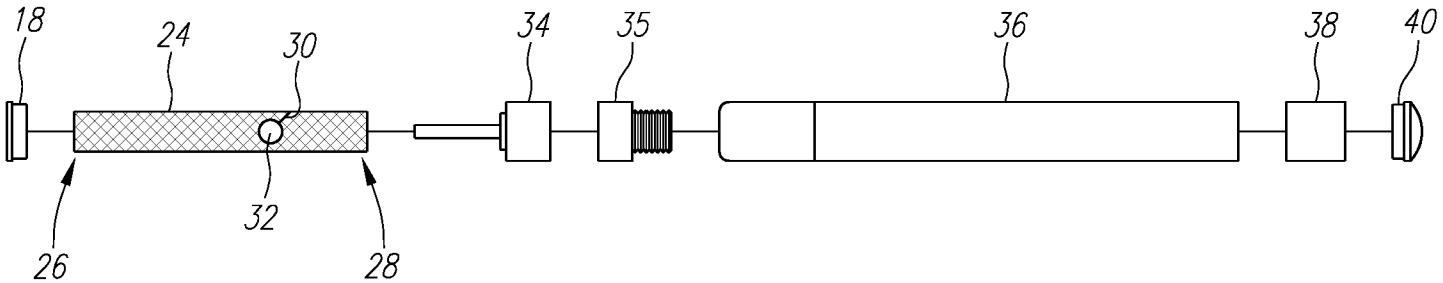
FIG. 2 is a schematic view of the components of the electronic smoking article of FIG. 1 according to an aspect of the disclosure.

FIG. 2 is a schematic view of the components of the electronic smoking article of FIG. 1. An air tube 24 extends longitudinally within the cartomizer 12, and has a proximal end 26 and a distal end 28. The air tube 24 can be formed from woven fiberglass, Kevlar® fiber, plastic, silicone, or any material that is flexible and heat resistant, for example. The air tube 24 includes a slit 30 leading to an aperture 32 configured to position and hold a heater coil 46 (shown in FIGS. 3, 9, and 10) and a wick 48 (shown in FIGS. 3 and 10). In some embodiments, the air tube 24 may include the slit 30 without the aperture 32. In this case, the slit 30 can be configured to position and hold the heater coil 46 and the wick 48. Although the slit 30 and the aperture 32 are located near the distal end 28 of the air tube 24 in FIG. 2, the slit 30 and the aperture 32 may be located at any position along the length of the air tube 24. When the slit 30 and the aperture 32 (positioning the heater coil 46 and wick 48) are located more proximally along the length of the air tube 24, the vapor inhaled by a user will be hotter; whereas when the slit 30 and the aperture 32 (positioning the heater coil 46 and wick 48) are located more distally along the length of the air tube 24, the vapor inhaled by a user will be less hot.

A fixing ring 34 and a threaded element 35 can be used to connect the cartomizer 12 to the eCig body 14 (shown in FIG. 1) The eCig body 14 can contain a battery assembly 36, a sensor assembly 38 and a lens cap 40. The sensor assembly 38 can include a pressure sensor or flow sensor (not shown) that can be configured to sense when a user inhales on the eCig 10. The sensor assembly 38 can also include a controller (not shown), such as a microcontroller or an application-specific integrated circuit (ASIC), as well as an LED (not shown). In response to sensed inhalation, the sensor assembly 38 can activate the battery assembly 36. The battery assembly 36 can include a lithium-ion rechargeable battery, which, when activated, can heat the heater coil 46 and e-juice. The LED can be configured to light up when a user inhales. The light from the LED can shine through the lens cap, thereby simulating a flame.

Figure 3:
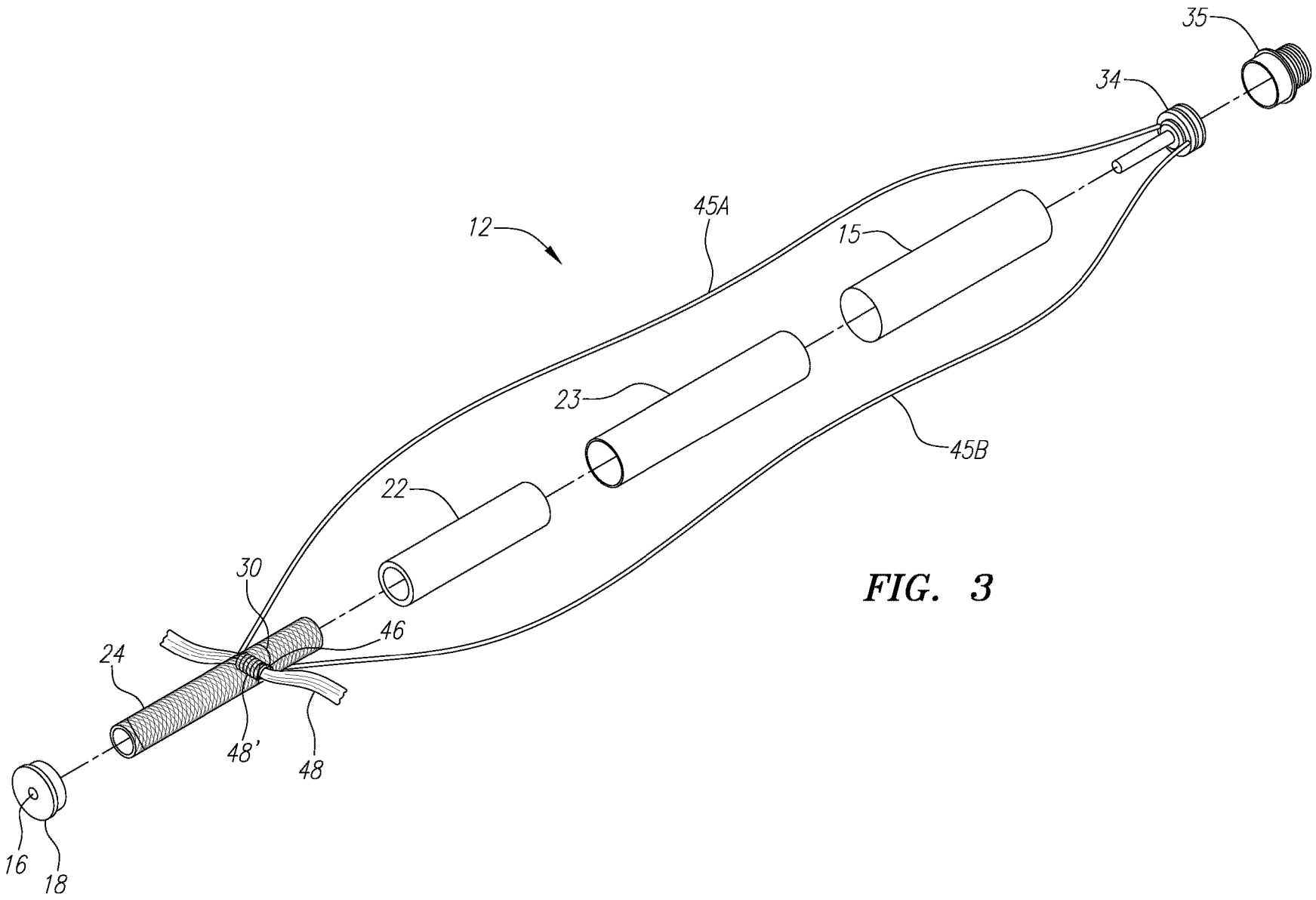
FIG. 3 is an isometric exploded view of the components of the cartomizer of the electronic smoking article of FIG. 1 according to an aspect of the disclosure.

FIG. 3 is an isometric exploded view of the components of the cartomizer 12 of the eCig 10 in FIG. 1. The heater coil 46 and the wick 48 are shown positioned within the aperture 32 (shown in FIG. 2) of the slit 30. Wick portion 48' is the portion of the wick 48 that is in contact with the heater coil 46. The air tube 24 is surrounded by a filler 22. The filler is surrounded by a plastic tube 23, which in turn is surrounded by the outer housing 15 of the cartomizer 12. The filler 22, such as cotton or another fiber, is configured to hold a solution (i.e. e-juice) containing flavoring and/or nicotine. Wires 45A and 45B extend from the two ends of the heater coil 46 through the fixing ring 34 to the battery 36 and sensor assembly (shown in FIG. 2), and can electronically couple the battery and heater coil 46.

Figure 4:
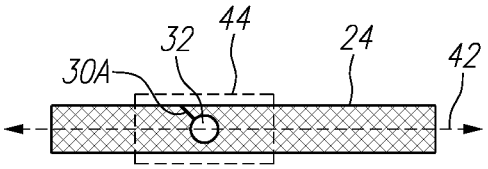
FIGS. 4-8 are schematic views of various embodiments of the air tube of FIG. 2 according to an aspect of the disclosure.

FIGS. 4-7 are schematic views of various embodiments of the air tube 24 depicted in FIGS. 2 and 3. FIG. 4 depicts the air tube 24 with an angled slit 30A (e.g., an angle between 0 and 90 degrees) with respect to the central longitudinal axis 42 of the air tube 24. In addition, an optional secondary sleeve 44 is shown covering the slit 30A and aperture 32 in FIG. 4. The secondary sleeve can be configured to slide along the length of the air tube 24. The secondary sleeve 44 an be made from the same or similar material as the air tube 24 (e.g., woven fiberglass, Kevlar® fiber, plastic, silicone, or any material that is flexible and heat resistant). The secondary sleeve 44 can be used to help keep the heater coil and wick in place and to help maintain the integrity of the air tube 24.

Figure 5:
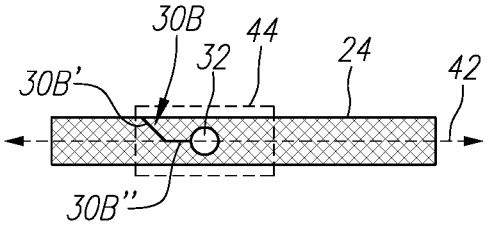
Figure 6:
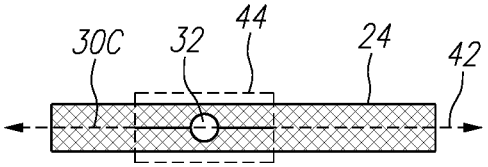
Figure 7:
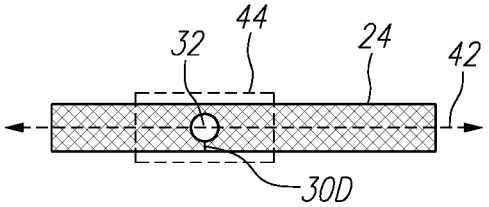
Figure 8:
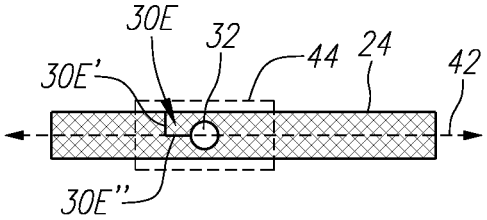

FIG. 5 depicts the air tube 24 with a bidirectional slit 30B which is angled at section 30B' and parallel at section 30B" to the central longitudinal axis 42 of the air tube 24. FIG. 6 depicts the air tube 24 with a slit 30C that is parallel to the central longitudinal axis 42 of the air tube 24 and runs along the length of the air tube 24. In this embodiment, the secondary sleeve 44 can be particularly important for maintaining the integrity of the air tube 24. FIG. 7 depicts the air tube 24 with a slit 30D that is perpendicular to the central longitudinal axis 42 of the air tube 24. FIG. 8 depicts the air tube 24 with a bidirectional slit 30E that is perpendicular at section 30E' and parallel at section 30E" to the central longitudinal axis 42 of the air tube 24. Other placements of a slit in air tube 24, besides those shown in FIGS. 4-8, are also contemplated.

Figure 9:
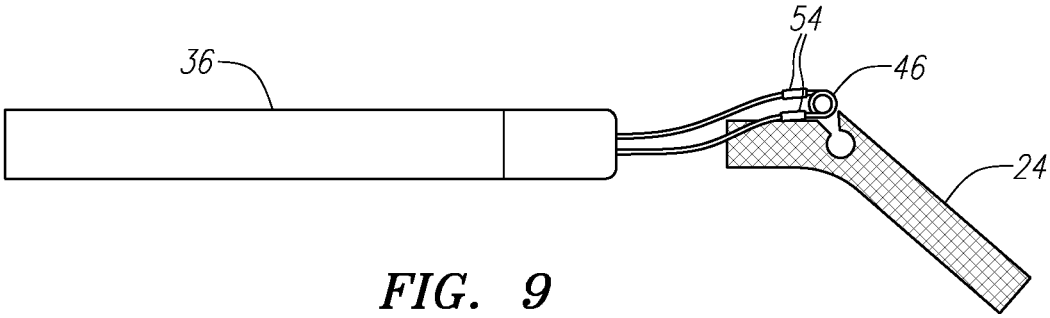
FIG. 9 is a schematic view of a heater coil and its positioning within the air tube according to an aspect of the disclosure.
Figure 10:
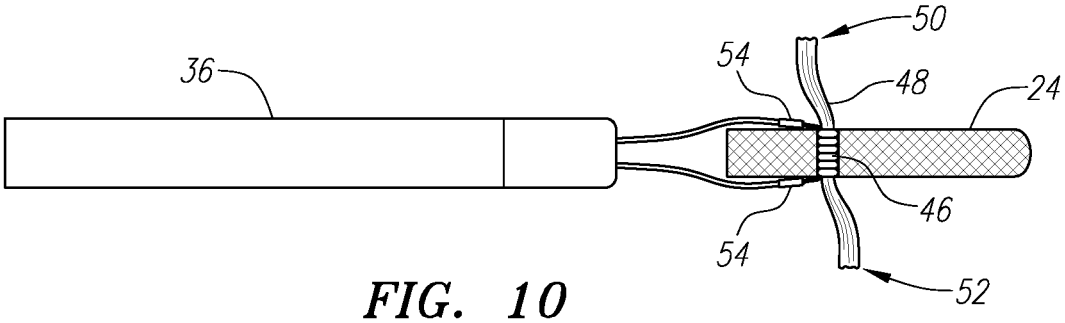
FIG. 10 is a schematic view of the positioning of the heater coil and wick within the air tube according to an aspect of the disclosure.

FIGS. 9 and 10 are schematic views of the air tube 24 with a heater coil 46 and a wick 48 positioned in the aperture 32 of slit 30. The fixing rings 34 (shown in FIGS. 2 and 3) are not shown in FIGS. 9 and 10 for clarity. The heater coil 46 can be made from nichrome wire, Kanthal, or any resistive metallic element, for example. In an embodiment, the heater coil 46 is about 2.6 mm long (as assembled in its coiled state) and contains about 5-8 turns, as shown in FIG. 10. The heater coil 46 can be evenly wound around wick portion 48' (see FIG. 3). The wick 48 can be between about 1 cm and about 5 cm long, and it can be comprised of a wide variety of materials, including silica, metal mesh, fiberglass, cotton, ceramic-coated fiberglass, ceramic-coated silica, or plastic, for example. The diameter of the wick 48 can be between about 1.5 mm and about 3 mm, for example. However, when the wick 48 is wound in the heater coil 46, the diameter of wick portion 48' (see FIG. 3) can be compressed, ensuring consistent contact between the coil and the wick and, therefore, more efficient vaporization.

The ends 50, 52 of the wick 48 are configured to stick out of both ends of the heater coil 46 and to contact the liquid or e-juice containing flavoring and/or nicotine (not shown). The liquid moves to the center of the wick 48, including wick portion 48' (see FIG. 3) which is in contact with the heater coil 46, via capillary action. Thus, when the heater coil 46 is powered by the battery assembly 36, the liquid is heated and ultimately vaporized for inhalation by a user. By positioning the heater coil 46 and wick 48 in the slit 30/aperture 32, as shown in FIGS. 9 and 10, the transfer of nicotine and vapor from the cartomizer to the user can be maximized. In an example, the heater coil 46 and the wick 48 are centered within the air tube 24, so that wick portion 48' (see FIG. 3),the portion of the wick 48 that is surrounded by the heater coil 46, is not touching anything (e.g., the sides of the air tube 24) besides the liquid and the heater coil 46. If wick portion 48' were touching another structure within the eCig, the vaporized liquid could be reabsorbed by that structure rather than being entrained in the vapor. Similarly, the heater coil 46 is centered so that it is not touching anything besides wick portion 48' and the liquid, thereby avoiding heat transfer to any other structure besides wick portion 48' and liquid. Thus, in order to attain maximal thermal efficiency, placement of the heater coil 46 and the wick 48 in the center of the air tube 24 via slit 30/aperture 32 maximizes the transfer of vapor and nicotine from the cartomizer to the user.

In an embodiment, the ends of the heater coil 46 can be connected to the battery 36 and control circuitry of the eCig via crimp connectors 54, as known in the electrical arts. In other embodiments, the ends of the heater coil 46 can be connected to the battery 36 and control circuitry of the eCig via soldering or welding.

Although embodiments of a wick-locating cartomizer have been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Various embodiments have been described above to various apparatuses, systems, and/or methods. Numerous specific details have been set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated above are non-limiting examples, and thus it can be appreciated that the specific structural and functional details disclosed above may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

What is claimed is:

1. A cartomizer comprising:

an air tube extending longitudinally within a housing, the air tube comprising a proximal end, a distal end, and a central longitudinal axis;

a heater coil positioned within the air tube;

a wick including a wick portion configured to be held and surrounded by the heater coil;

and a movable secondary sleeve surrounding the heater coil and the wick portion;

wherein the air tube further comprises a slit leading to an aperture configured to position the heater coil; and wherein the heater coil is positioned within the aperture such that the wick portion does not come into contact with the air tube.

2. The cartomizer of claim 1, wherein the heater coil is positioned along the central longitudinal axis of the air tube.

3. The cartomizer of claim 1, wherein the wick is configured to extend from a first end of the heater coil and from a second end of the heater coil; wherein the wick is configured to contact a liquid within an electronic smoking article; and wherein the wick is configured to avoid contact with an inner wall of the air tube.

4. The cartomizer of claim 1, wherein the air tube comprises a flexible, heat-resistant material.

5. The cartomizer of claim 4, wherein the air tube comprises at least one of the following materials: woven fiberglass, plastic, aramid fibers, and silicone.

6. The cartomizer of claim 1, wherein the heater coil comprises a resistive metallic material.

7. The cartomizer of claim 6, wherein the heater coil comprises at least one of the following materials: nichrome wire and kanthal.

8. The cartomizer of claim 1, wherein the heater coil comprises between about 5 and about 8 coil turns.

9. The cartomizer of claim 1, wherein the heater coil is about 2.6 mm in length.

10. The cartomizer of claim 1, wherein the heater coil is connected to a battery or to control circuitry of an electronic cigarette via a crimped connection.

11. The cartomizer of claim 1, wherein the slit of the air tube comprises at least one of the following: an opening that is perpendicular to a central longitudinal axis of the air tube, an opening that is parallel to the central longitudinal axis of the air tube, and an opening that is angled between about 0 degrees and about 90 degrees with respect to the central longitudinal axis of the air tube.

12. The cartomizer of claim 1, wherein the movable secondary sleeve is configured to surround the slit and the aperture in the air tube and to maintain the integrity of the air tube.

13. The cartomizer of claim 1, wherein the slit is located midway between the proximal end and the distal end of the air tube.

14. The cartomizer of claim 1, wherein the slit is located adjacent to the proximal end of the air tube.

15. The cartomizer of claim 1, wherein the slit is located adjacent to the distal end of the air tube.

16. The cartomizer of claim 1, wherein the wick comprises at least one of the following: silica, metal mesh, fiberglass, cotton, ceramic-coated fiberglass, ceramic-coated silica, and plastic.

17. The cartomizer of claim 1, wherein the wick is between about 1 cm and about 5 cm long.

18. The cartomizer of claim 1, wherein the heater coil is further configured to compress a diameter of the wick.

19. An electronic smoking article comprising a cartomizer comprising (i) an air tube extending longitudinally within a housing, the air tube comprising a proximal end, a distal end, and a central longitudinal axis, (ii) a heater coil positioned within the air tube, iii) a wick including a wick portion configured to be held and surrounded by the heater coil, and iv) a movable secondary sleeve surrounding the heater coil and the wick portion; wherein the air tube further comprises a slit leading to an aperture configured to position the heater coil; and wherein the heater coil is positioned within the aperture such that the wick portion does not come into contact with the air tube; and a battery part configured to be coupled with the cartomizer.

* * * * *